United States Patent [19]

Hicks

[11] Patent Number: 4,698,855

[45] Date of Patent: Oct. 13, 1987

[54] DISPOSABLE TRY-ON'S

[76] Inventor: Josephine Hicks, 514 W. 152nd St., Apt. 16, New York, N.Y. 10031

[21] Appl. No.: 860,909

[22] Filed: May 8, 1986

[51] Int. Cl.[4] ..... A41B 9/00; A61F 13/16

[52] U.S. Cl. ..... 2/402; 2/403; 2/406; 604/385 R

[58] Field of Search ..... 2/402, 403, 406, 78 R, 2/78 B; 604/385 R, 384, 389, 390, 385.1

[56] References Cited

U.S. PATENT DOCUMENTS

| | | | |
|---|---|---|---|
| 3,481,337 | 12/1969 | Ruffo | 604/385.1 |
| 3,561,446 | 2/1971 | Jones | 604/385.1 |
| 3,650,273 | 3/1972 | Schaar | 2/402 |
| 3,978,861 | 9/1976 | Schaar | 604/385 R |
| 4,100,922 | 7/1978 | Hernandez | 604/385.1 |
| 4,122,552 | 10/1978 | Tedford | 2/78 R |

*Primary Examiner*—H. Hampton Hunter
*Attorney, Agent, or Firm*—Richard L. Miller

[57] ABSTRACT

This invention is a disposable panty made from a single rectangular sheet of paper or plastic, having two side by side leg holes at its center, and then being folded over across the leg holes so as to form front and rear panels, and the overlapped side edges of the panels being taped together.

1 Claim, 5 Drawing Figures

DISPOSABLE TRY-ON'S

BACKGROUND OF THE INVENTION

This invention relates generally to department store, dressing room accessories. More specifically it relates to disposable sanitary undergarment for use by a store customer trying on a garment for size before purchasing it, so as to prevent spread of disease by another person also trying on the same undergarment.

Protective wear of this type has been developed in the past, as is evident by U.S. Pat. No. 2,629,380 to Schweikert and No. 4,122,552 to Tedford. However, these devices are not designed particularly for store dressing room use where persons of all different size are in need of it, and wherein after a single use of only a few moments, it is promptly disposed, so that it must be made very inexpensively in order to be practical. Accordingly such sanitary disposable undergarment is not yet made available in store dressing rooms, and there still remains at this time a need for the same.

SUMMARY OF THE INVENTION

Therefore it is a principal object of the present invention to provide a disposable try-on that is ideal for use in public dressing rooms of stores by being very inexpensive so that stores can freely supply it to their customers.

Another object is to provide a disposable try-on which will readily fit all sizes of customers.

Another object are to provide a disposable try-on which is simple in design, easy to put on and which promotes good health.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
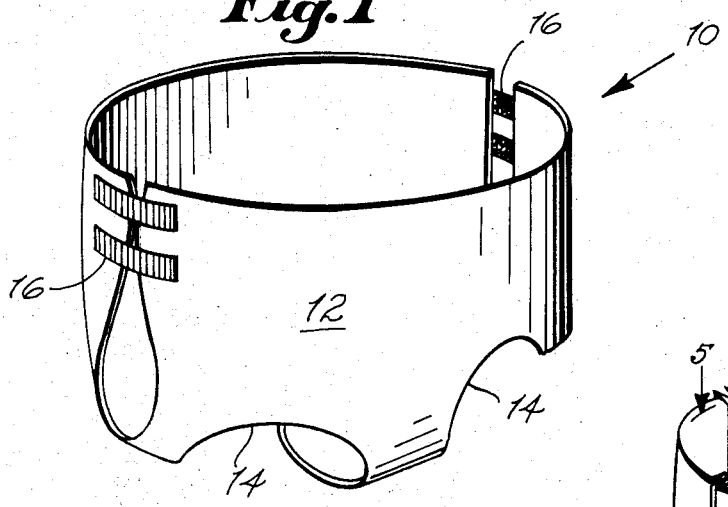
FIG. 1 is a perspective view of the invention.
Figure 2:
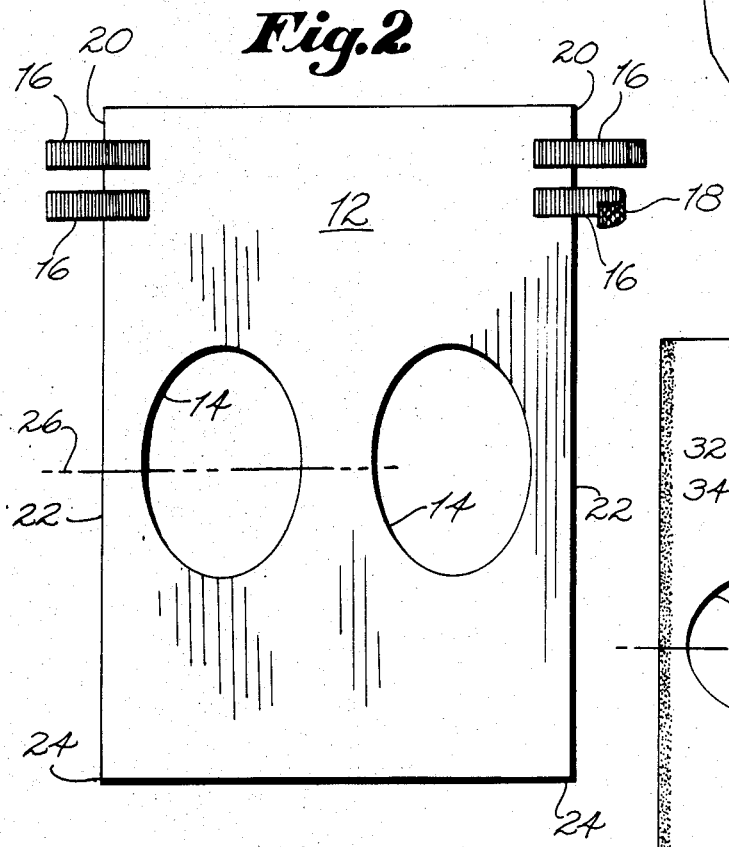
FIG. 2 is a plan view of a material cut to a shape which is than folded to form the invention.

Referring now to the Drawing in greater detail, and more particularly to FIGS. 1 and 2 thereof at this time, the reference numeral 10 represents a disposable try-on, according to the present invention, wherein the same is made from a flat, rectangular sheet of material 12 such as paper or thin polyethylene plastic film and which is die-cut with two oval-shaped openings 14 to serve as leg holes for a wear. A pair of tapes 16, having pressure sensitive adhesive 18 on one side, are adhered near each corner 20 of opposite side edges 22 and include extending tail portions as shown in FIG. 2, which adhere to the opposite corner 24 of the same longitudinal side edge when the sheet is afterwards folded over about a transverse fold line 26 extending across a center of the leg holes for bringing the corners adjacent each other and thus forming a finished panty to serve as a try-on.

It may be made in various sizes so as to fit larger or smaller person, including children and adults.

In operative use, when a store customer wishes to try on a garment in the store before purchasing it, the customer first removes his or her own garment and then steps into the try-on 10 before donning the store garment. This is especially important in situations where a person's crotch area contacts a new garment. After being used by a customer, the try-on 10 is discarded.

Figure 3:
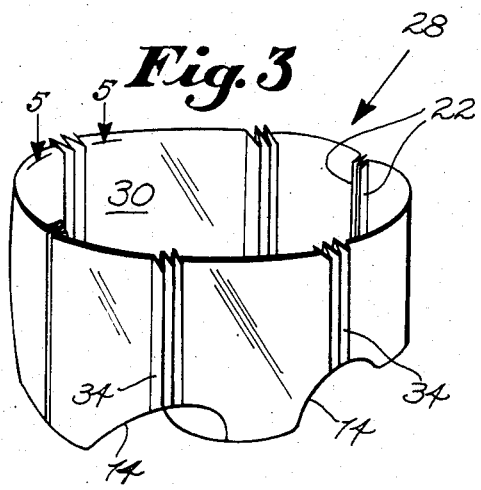
FIG. 3 is a perspective view of another design of the invention, made of thin polyethylene, and including expandable pleats to fit different size persons.
Figure 4:
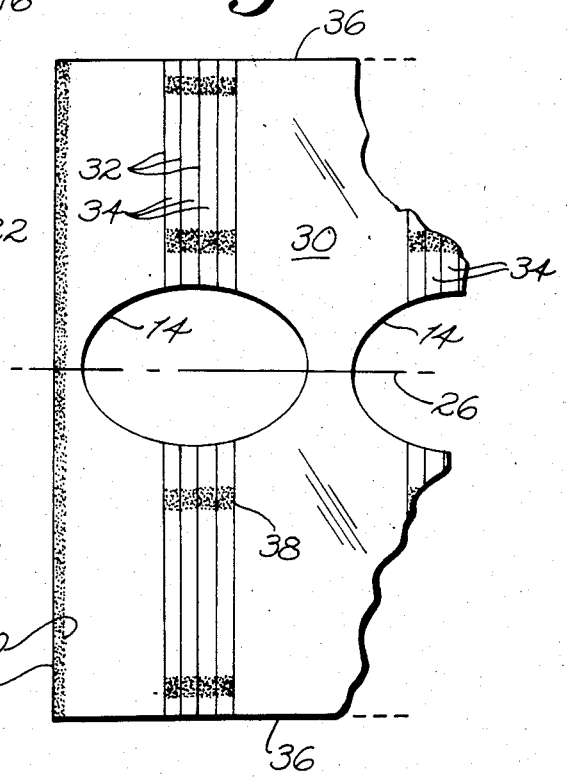
FIG. 4 is a fragmentary plan view thereof shown prior to being folded.
Figure 5:
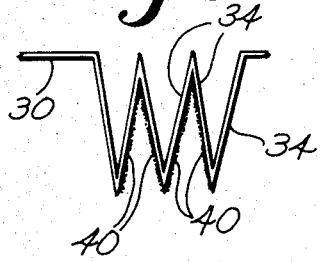
FIG. 5 is a greatly enlarged view taken on line 5—5 of FIG. 3 and showing pressure sensitive adhesive between the pleats for easy spreading apart.

Referring now to FIGS. 3 to 5, another design of try-on 28 is shown which is made to be expandable so that a single size of the try-on is suitable to fit numerous different sizes of persons, while still being cheaply made without any extra components providing stretch or expansiveness. This design of try-on is made of a thin polyethylene plastic sheet 30 and includes the above described leg openings 14, but is slightly wider in rectangular shape so as to include a plurality of folds 32 transversely across each leg opening for forming pleats 34 that extend to the opposite end edges 36. Pressure sensitive adhesive 38 is applied across the pleats so that when then folded, the pleats adhere together in folded over condition. The leg openings are accordingly die-cut wider so as to have a narrower width after the pleats are folded. Opposite side edges 22 include pressure sensitive adhesive 40 applied directly thereto for adhering together and thus eliminate the separate tape components described above. When the sheet is folded over into final shape, the pleats adhere together and the side edges 22 adhere together forming a panty.

In operative use, the try-on as made, will fit a small individual, however another person having a wider waist or wider thighs may readily pull apart as many of the pleats as necessary for fitting thereinto. Pulling apart only the upper ends of the pleats will accommodate a wider waistline, whereas pulling apart only the lower ends of the pleats will accommodate thicker thighs.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A disposable try-on, comprising, in combination, a panty made from a folded up flat sheet of thin polyethylene plastic film, said sheet being rectangular in shape, a pair of oval shaped leg openings die cut on said sheet such that parts of the sheet completely surround the openings, and a fold line transversely across a center of said leg openings about which said sheet is folded and opposite corners of said sheet are aligned, and adhesive means are added to form said panty, said panty including a plurality of expandable pleats extending across the flat sheet and spanning transversely across each leg opening for accommodating persons of larger size and adhesive material between the pleats for holding the pleats together until they are pulled apart, said adhesive material being located adjacent the opposing edges of the flat sheet permitting pulling apart of the pleats for larger waist size, and located adjacent said leg openings permitting pulling apart of the pleats for larger thigh sizes, each of the adhesives being selectively able to be pulled apart at the portions adjacent the edges and the portion adjacent the openings.

* * * * *